United States Patent [19]

McClain

[11] Patent Number: 4,859,149

[45] Date of Patent: Aug. 22, 1989

[54] BLADE LOCKING SYSTEM

[75] Inventor: John C. McClain, Plainfield, Ind.

[73] Assignee: General Motors Corporation, Detroit, Mich.

[21] Appl. No.: 321,822

[22] Filed: Mar. 10, 1989

[51] Int. Cl.[4] ..... F01D 5/32

[52] U.S. Cl. ..... 416/215; 416/193 A

[58] Field of Search ..... 416/215, 193 A, 216, 416/217, 218

[56] References Cited

U.S. PATENT DOCUMENTS

| | | | |
|---|---|---|---|
| 3,088,708 | 5/1964 | Feinberg | 416/215 |
| 3,216,700 | 11/1965 | Bostock, Jr. | 416/216 |
| 3,263,962 | 8/1966 | Dickey | 416/215 |
| 3,721,506 | 3/1973 | Anderson | 416/215 |
| 3,902,824 | 9/1975 | Sauer | 416/215 |
| 3,954,350 | 5/1976 | Zahring | 416/215 |
| 4,465,432 | 8/1984 | Mandet et al. | 416/215 |
| 4,684,325 | 8/1987 | Arnold | 416/215 |

FOREIGN PATENT DOCUMENTS

| | | | |
|---|---|---|---|
| 2423690 | 11/1975 | Fed. Rep. of Germany | 416/215 |
| 2156908 | 10/1985 | United Kingdom | 416/215 |

*Primary Examiner*—Everette A. Powell, Jr.
*Attorney, Agent, or Firm*—Saul Schwartz

[57] ABSTRACT

A locking system for blades in a circumferential dovetail groove in a rotor of a gas turbine engine, the blades having dovetail roots in the groove and platforms resting on steady rest flanges on the outside surface of the rotor on opposite sides of the slot between converging shoulders of the dovetail groove. The blade locking system includes an inner lock member between roots of a pair of adjacent blades, an outer lock member captured in aligned notches in the steady rest flanges between the rotor and the platforms of the adjacent blades, and a screw extending through a clearance hole in the outer lock member into a threaded bore in the inner lock member. When the screw is tightened, the inner and outer lock members are clamped against the rotor.

3 Claims, 1 Drawing Sheet

BLADE LOCKING SYSTEM

FIELD OF THE INVENTION

This invention relates to locking systems for rotor blades on gas turbine engine rotors.

BACKGROUND OF THE INVENTION

A typical blade mounting arrangement for axial compressor blades on a rotor in a gas turbine engine includes dovetail roots on the blades received in a circumferential dovetail groove in the rotor. The dovetail roots are inserted serially into the groove through a small loading slot until the groove is full. All the blades in the groove are then shifted as a unit until the loading slot is between two blade roots and the blade stage is locked against further movement. A typical locking system for the blades includes an insert in the dovetail groove between the roots of adjacent blades which is jacked into a locking position in a notch in the converging sides of the dovetail groove wall. The insert is jacked into position by a screw which is accessible from between adjacent blades and which bears against the bottom of the dovetail groove. The notch prevents movement of the blade stage but also reduces the durability of the rotor. A blade locking system according to this invention features an insert in the dovetail groove which operates without a corresponding notch in the converging sides of the dovetail groove.

SUMMARY OF THE INVENTION

This invention is a new and improved locking system for rotor blades on a rotor of a gas turbine engine, the rotor being of the type having a circumferential dovetail groove therearound flanked on opposite sides by a pair of steady rest flanges and the blades being of the type having dovetail roots in the dovetail groove, airfoils radially outboard of the dovetail groove, and platforms between the roots and the airfoils which rest on the steady rest flanges for stability. In the locking system according to this invention, an inner lock member is disposed in the dovetail groove between the roots of a pair of adjacent rotor blades and radially inboard of a planar outer lock member which is inserted between the outside diameter of the rotor and the platforms of the adjacent blades into aligned notches in the steady rest flanges. The notches in the steady rest flanges prevent circumferential movement of the outer lock member and the outer lock member is attached to the inner lock member by a screw threaded into the inner lock member. The screw is accessible through notches in the adjacent blade platforms and when tightened clamps the inner and outer lock members against the rotor.

DESCRIPTION OF A PREFERRED EMBODIMENT

Figure 2:
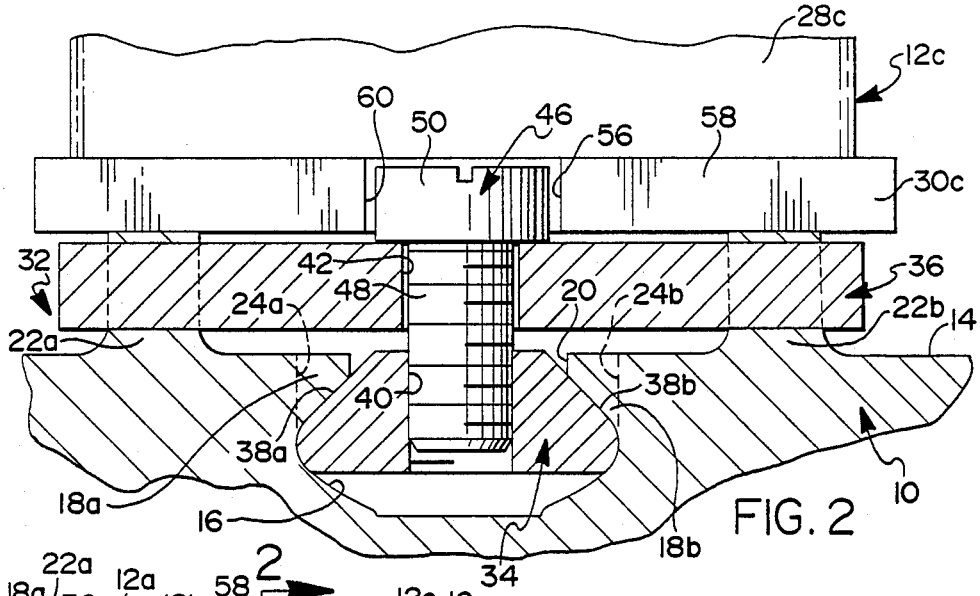
FIG. 2 is an enlarged sectional view taken generally along the plane indicated by lines 2—2 in FIG. 1.
Figure 1:
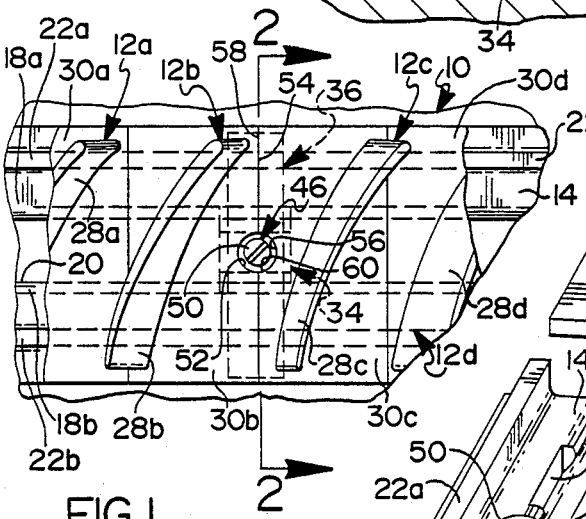
FIG. 1 is a plan view of a portion of a gas turbine engine rotor having a blade locking system according to this invention.
Figure 3:
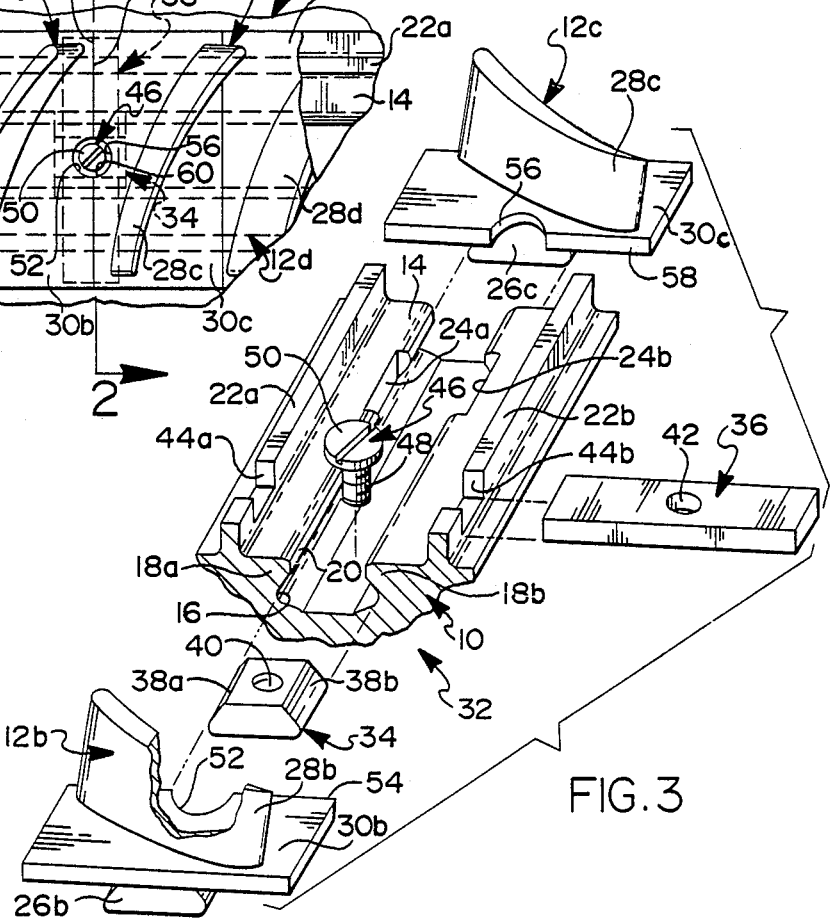
FIG. 3 is an exploded perspective view of a portion of FIG. 1 showing the blade locking system according to this invention.

Referring to FIGS. 1–3, a gas turbine engine rotor 10, such as an axial compressor rotor, has a plurality of rotor blades thereon arranged in a circumferential stage, only four blades 12*a–d* being illustrated. The rotor 10 may have additional stages of blades. The rotor 10 has a cylindrical outside surface 14 centered on the axis of rotation of the rotor, not shown. The rotor 10 also has a circumferential dovetail groove 16 therein flanked on opposite sides by a pair of converging shoulders 18*a–b* which define between themselves a slot 20. The slot 20 is flanked on opposite sides by a pair of steady rest flanges 22*a–b* which project above the cylindrical outside surface 14. The rotor has a pair of aligned notches 24*a–b*, FIG. 1, in the converging shoulders 18*a–b* which cooperate to form a loading slot for the blades 12*a–d*.

Each of the rotor blades 12*a–d* has a dovetail root shaped to match the shape of the dovetail groove 16, only dovetail roots 26*b* and 26*c* being shown in FIG. 3, an airfoil 28*a–d* and an integral flat platform 30*a–d* between the root and the airfoil. Because the dovetail roots are not as long as the platforms in the circumferential direction of the rotor, spaces remain between the roots when the platforms abut. The blade stage is locked in place in the dovetail groove 16 by a locking system 32 according to this invention.

The locking system 32 includes an inner insert or lock member 34 in the dovetail groove 16 and a planar outer insert or lock member 36. The inner member 34 includes a pair of shoulders 38*a–b* contoured to match the radially inboard surfaces of the converging shoulders 18*a–b* on the rotor and a threaded bore 40 between the shoulders 38*a–b* which registers with the slot 20. The outer lock member 36 resembles a flat bar and includes a clearance hole 42 generally in the center thereof. The outer lock member rests on or parallel to the outer cylindrical surface 14 of the rotor 10 and is captured at its opposite ends in respective ones of a pair of aligned notches 44*a–b*, FIG. 3, in the steady rest flanges 22*a–b*.

The locking system 32 further includes a screw 46 having a threaded shank 48 and an enlarged head 50. The shank 48 extends through the clearance hole 42 in the outer lock member 36 and is threaded into the bore 40 in the inner lock member 34. When the screw is tightened, the outer lock member is clamped against the outside surface 14 of the rotor or the steady rest flanges 22*a–b* and the inner lock member is clamped against the converging shoulders 18*a–b*.

The installation of the rotor blades and the installation and operation of the locking system 32 are described as follows. Commencing with a first blade, it and succeeding ones of a first set of blades are serially installed on the rotor 10 by aligning their roots with the loading slot, lowering the roots into the slot 20 until the platforms engage the steady rest flanges 22*a–b*, and then sliding the blades along the dovetail groove to make way succeeding blades. The first set of rotor blades is less than the total number of blades in the stage and includes as a last one the rotor blade 12*b*, FIG. 3. The last blade 12*b* differs structurally from the other blades in the first set in that it includes a semi-circular notch 52 in an edge 54 of the platform 30*b* nearest the loading slot. The notch is centered over the slot 20.

After the last rotor blade 12*b* of the first set is installed, the inner lock member 34 is inserted through the loading slot and moved to a position adjacent the root 26*b* of the last blade. When thus positioned, the threaded bore 40 is aligned with the semi-circular notch 52 in the platform 30*b*.

The remaining rotor blades of the blade stage define a second set of blades that are sequentially installed on the rotor 10 the same way as the blades in the first set. The rotor blade 12*c* defines a first blade of the second set and differs structurally from the other blades in the second set in that it has a semi-circular notch 56 in an edge 58 of platform 30*c* facing the edge 54 of platform 30*b*. When the platform edges 54 and 58 abut, the semi-circular notches cooperate in defining a circular clearance aperture 60, FIG. 1, over the threaded bore 40 in the inner lock member 34. The diameter of the clearance aperture 60 exceeds the diameter of the head 50 of screw 46.

After the root of the last rotor blade, not shown, of the second set is lodged in the dovetail groove 16 under the loading slot, the entire blade stage is shifted or indexed a distance exceeding the length of the loading slot so that none of the roots of the blades overlaps the loading slot. The location of the notches 44*a–b* in the steady rest flanges 22*a–b* is coordinated with the location of the loading slot such that when the entire blade stage is indexed as described, both the clearance aperture 60 between the platforms 30*b–c* and the inner lock member 34 register with the notches 22*a–b* in the steady rest flanges. The outer lock member 36 is then inserted between the cylindrical surface 14 of the rotor and the radially inside surfaces of the platforms 30*b–c* of the rotor blades until the clearance hole 42 therein is aligned with the clearance aperture 60.

The outer lock member is captured at opposite ends by the sides of the notches 22*a–b* in the steady rest flanges and can not move circumferentially relative to the rotor 10. The shank 48 of the screw 46 is passed through the clearance aperture 60 and through the clearance hole 42 in the outer lock member and is threaded into the inner lock member. With the head 50 of the screw against the outer lock member, FIG. 2, the screw is tightened by a screw driver inserted between the airfoils into the clearance aperture to draw the inner lock member toward the outer lock member. At a predetermined screw torque, the inner and outer lock members are clamped against the rotor.

The placement of the notches 44*a–b* in the steady rest flanges 22*a–b* rather than in the converging shoulders 18*a–b* of the rotor is an important feature of this invention because the steady rest flanges are considerably less highly stressed than the converging shoulders 18*a–b*. Accordingly, the rotor 10 is more durable than would be the case if the converging shoulders were notched in accordance with prior practice. In addition, since the inner lock member 34 does not mate with any slots in the converging shoulders, the blind assembly previously required is obviated. Finally, the outer lock member 36 continues to function even if the screw 46 escapes. In that event, the escape movement of the outer lock member in its length direction, the only possible escape direction, interferes with seals or like structure near the blade stage. Such engagement represents a malfunction signal upon which the engine is shut down before the outer lock member is completely lost.

The embodiment of the invention in which an exclusive property or privilege is claimed are defined as follows:

1. In a rotor assembly including means on said rotor defining an outside cylindrical surface, a dovetail groove extending circumferentially around said rotor having a pair of converging shoulders which define therebetween a slot in said outside cylindrical surface, a pair of circumferentially extending steady rest flanges on said outside cylindrical surface on opposite sides of said slot, a plurality of rotor blades each having an airfoil and a root and a platform between said airfoil and said root, and a pair of aligned notches in said converging shoulders defining a loading slot for insertion of said blade roots into said dovetail groove, a blade lock comprising:

an inner lock member slidably disposed in said dovetail groove and spanning said slot between said converging shoulders so that said inner lock member is radially captured in said dovetail groove, means defining a pair of aligned notches in said steady rest flanges on opposite sides of said slot in said outside cylindrical surface, an outer lock member disposed between said outside cylindrical surface and said platforms of a pair of adjacent ones of said rotor blades and captured in said aligned slots so that said outer lock member is immobilized with respect to circumferential bodily shiftable movement relative to said rotor, means on each of said platforms of said adjacent ones of said rotor blades cooperating in defining a clearance aperture through said platforms, and connecting means between said inner and said outer lock members accessible through said clearance aperture and operable to clamp each of said inner and said outer lock members against said rotor.

2. The blade lock recited in claim 1 wherein said connecting means includes means defining a threaded bore in said inner lock member radially inboard of and aligned with said slot, means defining a clearance hole in said outer lock member aligned with said threaded bore in said inner lock member, and a fastener having a shank extending through said clearance hole and threaded into said threaded bore and a head radially outboard of said outer lock member and engageable thereon when said fastener is turned.

3. A method of assembling and locking a plurality of rotor blades on a rotor, said rotor having an outside cylindrical surface, a circumferentially extending dovetail groove including a pair of converging shoulders defining therebetween a slot in said outside cylindrical surface, a pair of circumferentially extending steady rest flanges on said outside cylindrical surface on opposite sides of said slot, and a pair of aligned notches in said converging shoulders defining a loading entry, and each of said rotor blades having a root and an airfoil and a platform between said root and said airfoil, comprising the steps of:

forming a pair of aligned notches in said steady rest flanges on opposite sides of said slot, forming an inner lock member with a threaded bore Therein and a pair of shoulders on opposite sides of said threaded bore, forming a generally planar elongated outer lock member with a clearance hole therein, serially installing a first set of said rotor blades on said rotor by inserting said root of each of said first set of rotor blades into said dovetail groove through said loading slot until said platform abuts each of said steady rest flanges, inserting an inner lock into said dovetail groove adjacent said root of a last one of said first set of rotor blades with said shoulders thereof straddling said converging shoulders on said rotor and shifting each of said first set of rotor blades and said inner lock member circumferentially until said threaded bore in said inner lock member registers with said aligned notches in said steady rest flanges, serially installing a second set of said rotor blades on said rotor by inserting said root part of each of said second set of rotor blades into said dovetail groove through said loading slot until said platform abuts each of said steady rest flanges with said inner lock member disposed between said last one of said first set of rotor blades and a first one of said second set of rotor blades, inserting said outer lock member between said outside cylindrical surface and said platforms of said last rotor blade of said first set and said first rotor blade of said second set into said aligned notches in said steady rest flanges, forming a clearance notch in each of said platforms of said last rotor blade of said first set and said first rotor blade of said second set which cooperate in defining a clearance aperture in alignment with said clearance hole in said outer lock member, inserting a screw through said clearance aperture and through said clearance hole in said outer lock member and threading said screw into said threaded bore in said inner lock member, and tightening said screw to clamp said inner and said outer lock members against said rotor.

* * * * *